US011292107B1

(12) United States Patent
Chen

(10) Patent No.: US 11,292,107 B1
(45) Date of Patent: Apr. 5, 2022

(54) ENGAGEMENT STRUCTURE OF SOCKET WRENCH

(71) Applicant: Tzu-Chun Chen, Taichung (TW)

(72) Inventor: Tzu-Chun Chen, Taichung (TW)

(73) Assignee: YUNG FONG TOOLS CO., LTD., Taichung (TW)

( * ) Notice: Subject to any disclaimer, the term of this patent is extended or adjusted under 35 U.S.C. 154(b) by 0 days.

(21) Appl. No.: 17/124,512

(22) Filed: Dec. 17, 2020

(51) Int. Cl.
*B25B 13/46* (2006.01)
*B25B 13/06* (2006.01)

(52) U.S. Cl.
CPC ..... *B25B 13/463* (2013.01); *B25B 13/065* (2013.01)

(58) Field of Classification Search
CPC ..... B25B 13/463; B25B 13/065; B25B 13/06; B25B 13/466; B25B 23/0035; B25B 23/0014; B25B 23/02; B25B 23/10
USPC ..... 81/438, 60–63.2
See application file for complete search history.

(56) References Cited

U.S. PATENT DOCUMENTS 7,013,762 B2 * 3/2006 Hsien ..... B25B 13/04 81/124.3
2003/0121371 A1 * 7/2003 Chiu ..... B25B 13/461 81/63.1
2015/0290783 A1 * 10/2015 Liu ..... B25B 13/463 81/60
2020/0269397 A1 * 8/2020 Shih ..... B25B 13/04

* cited by examiner

*Primary Examiner* — Orlando E Aviles
*Assistant Examiner* — Jason Khalil Hawkins

(57) ABSTRACT

An engagement structure of a socket wrench contains: a body including a drive head, an accommodation chamber, a ratchet member received, a hexagonal groove, a circular large-diameter notch, multiple recessed, and a hexagonal small-diameter orifice. The hexagonal groove is configured to accommodate a locating sleeve. The locating sleeve includes an upper extension, a hexagonal positioning portion, a hexagonal receiving hole, multiple columns, two opposite central holes, two steel balls, and a slot. The locating sleeve further includes multiple springs fitted on the multiple columns of the multiple cutouts. The upper extension of the locating sleeve is connected with of the hexagonal small-diameter orifice and a hexagonal coupling aperture of a control disc, and a C-shaped retainer is engaged in the slot of the locating sleeve so that the C-shaped retainer abuts against the control disc, thus connecting the ratchet member, the locating sleeve, and the control disc.

4 Claims, 18 Drawing Sheets

ENGAGEMENT STRUCTURE OF SOCKET WRENCH

FIELD OF THE INVENTION

The present invention relates to an engagement structure of a socket wrench which engages or removes a socket easily by using a ratchet member, a locating sleeve, and two steel balls.

BACKGROUND OF THE INVENTION

Referring to FIGS. 13-18, a conventional engagement structure of a socket wrench is disclosed in U.S. Pat. No. 9,694,479 and contains a drive head 60 in which a locating sleeve 70 is accommodated. The locating sleeve 70 includes a hexagonal orifice 71 defined thereon, a toothed ratchet 74 formed on a central section of an outer rim of the locating sleeve 70. The drive head 60 further includes a first notch 61 defined on a top thereof, a second notch 62 formed on a bottom thereof, and a spring 63 accommodated in the first notch 61. The locating sleeve 70 has a receiving orifice 72 defined on an outer rim of an outer wall thereof so as to receive the steel ball 73, and the steel ball 72 is located on a tilted section 64 of the second notch 62.

When the socket 80 is inserted into the hexagonal orifice 71 of the locating sleeve 70, an upper end of the socket 80 contacts with the steel ball 73 and forces the locating sleeve 70 to move upward. When the steel ball 73 moves upward to the second notch 62, it moves outward to release the socket 80 and to move into the hexagonal orifice 71.

When a notch 81 of the socket 80 moves to the steel ball 73, the steel ball 73 engages between the locating sleeve 70 and the socket 80, such that the spring 63 of the first notch 61 pushes the locating sleeve 70 to move back to an original position downward and to engage with the socket 80. After pulling the locating sleeve 70 upward, the socket 80 is driven to move upward, and the steel ball 73 is pulled to the second notch 62, wherein when the steel ball 73 moves outward, the socket 80 is released.

However, a space of the toothed ratchet is reduced, and a thickness of the locating sleeve is too thin to provide operational torque sufficiently.

To increase a retracting height of the steel ball and to press the spring, a size of the first notch is more than a size of the second notch, thus increasing the thickness of the drive head and fabrication cost.

The locating sleeve is pulled to drive the toothed ratchet to move upward or downward, thus producing friction between a toothed actuation and the socket wrench to cause a damage of the engagement structure.

The steel ball cannot engage with the socket tightly.

The present invention has arisen to mitigate and/or obviate the afore-described disadvantages.

SUMMARY OF THE INVENTION

The primary aspect of the present invention is to provide an engagement structure of a socket wrench which to engage or remove a socket easily by using a ratchet member, a locating sleeve, and two steel balls.

To achieve above-mentioned aspect, an engagement structure of a socket wrench provided by the present invention contains: a body including a drive head, an accommodation chamber defined in the drive head, a ratchet member received in the accommodation chamber, a hexagonal groove formed in the ratchet head, a circular large-diameter notch formed on a bottom of the hexagonal groove, multiple recessed formed around six inner walls of the hexagonal groove, multiple cutouts formed on six corners of the six inner walls of the hexagonal groove, and a hexagonal small-diameter orifice defined on a top of the hexagonal groove.

The hexagonal groove of the ratchet member is configured to accommodate a locating sleeve, and the locating sleeve includes an upper extension, a hexagonal positioning portion integrally formed with the upper extension, a hexagonal receiving hole defined in the locating sleeve, multiple columns formed on six corners of an outer wall of the hexagonal positioning portion, two opposite central holes defined on two opposite sides of the outer wall of the hexagonal positioning portion, two steel balls received in the two opposite central holes, and a slot defined around a top of the outer wall of the hexagonal positioning portion.

When the locating sleeve is inserted into the ratchet member, the hexagonal positioning portion is limited in the hexagonal groove, and the multiple columns are fixed in the multiple cutouts. The locating sleeve further includes multiple springs fitted on the multiple columns of the multiple cutouts.

The upper extension of the locating sleeve is connected with of the hexagonal small-diameter orifice of the ratchet member and a hexagonal coupling aperture of a control disc, and a C-shaped retainer is engaged in the slot of the locating sleeve so that the C-shaped retainer abuts against the control disc, thus connecting the ratchet member, the locating sleeve, and the control disc.

Thereby, when a socket is inserted into the hexagonal receiving hole from a bottom of the locating sleeve, an insertion of the socket pushes the two steel balls of the hexagonal receiving hole and the locating sleeve to move upward; when the two steel balls move into the multiple recesses of the ratchet member, the socket is released to move into the hexagonal receiving hole; when a trench of the insertion of the socket moves to the two steel balls, the two steel balls engage into the trench and the two opposite central holes and are defined between the locating sleeve and the socket, and the multiple springs push the multiple columns so that the locating sleeve moves back to an original position downward, thus engaging the locating sleeve with the socket.

When releasing the socket, the control disc is pulled upward to drive the locating sleeve and the socket to move upward, and the two steel balls are pulled to the multiple recessed of the ratchet member and move outward, thus releasing the socket.

Preferably, the control disc includes a toothed fringe configured to rotate the control disc clockwise or counterclockwise in a limited space.

DETAILED DESCRIPTION OF THE PREFERRED EMBODIMENTS

Figure 1:
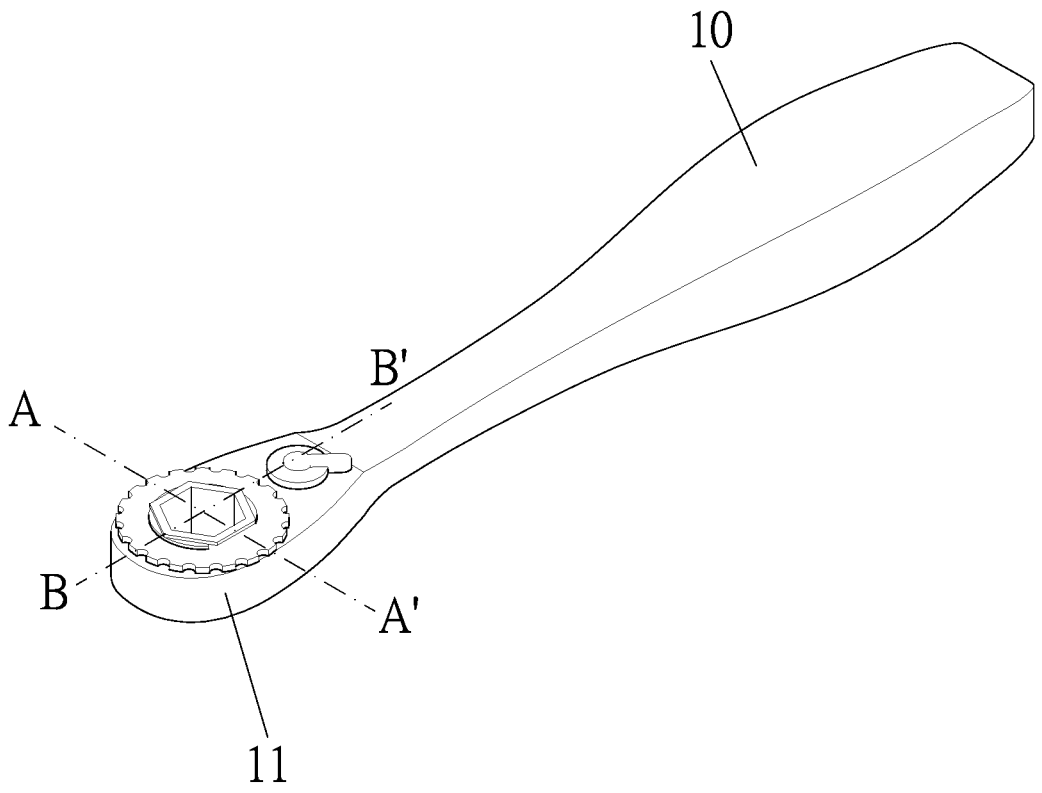
FIG. 1 is a perspective view showing the assembly of an engagement structure of a socket wrench according to a preferred embodiment of the present invention.
Figure 2:
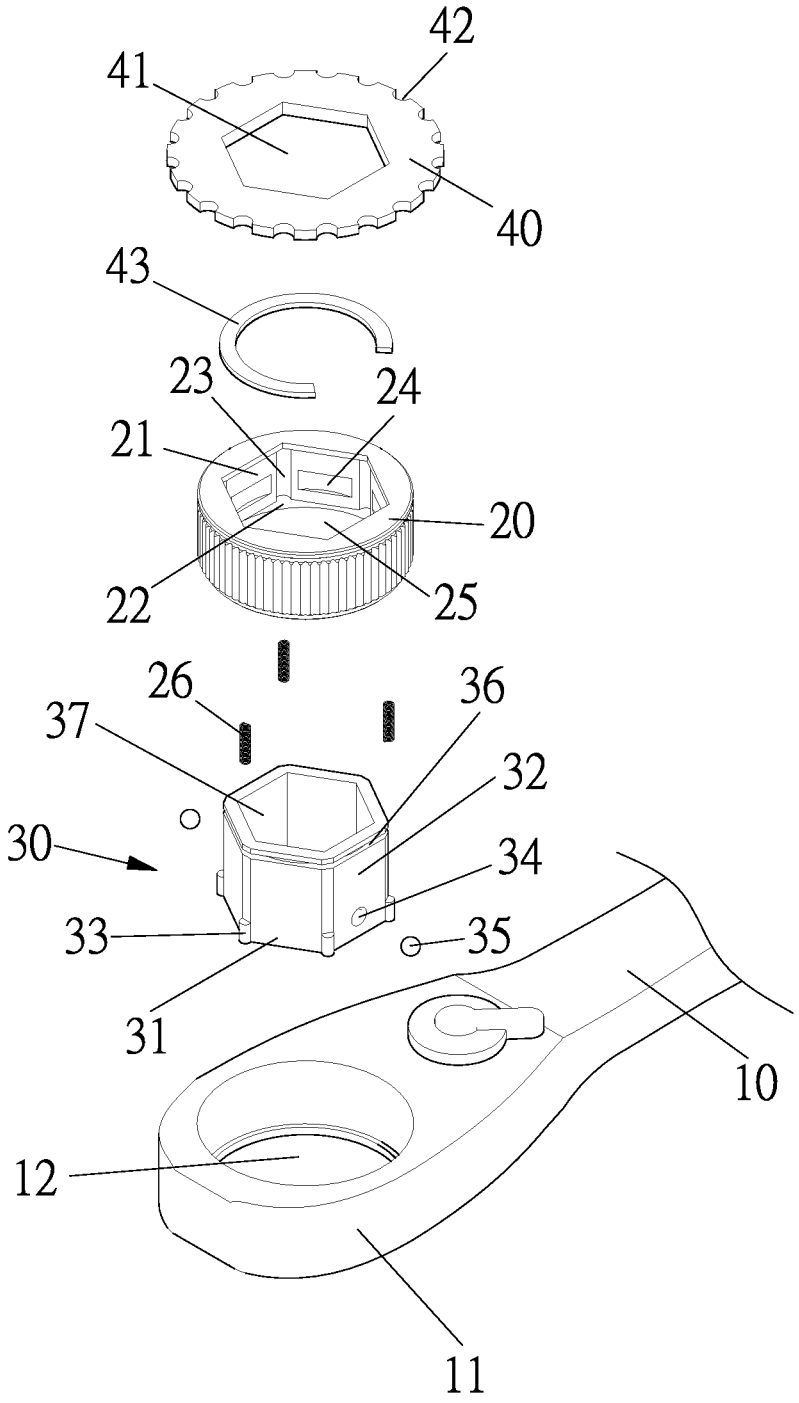
FIG. 2 is a perspective view showing the exploded components of the engagement structure of the socket wrench according to the preferred embodiment of the present invention.
Figure 3:
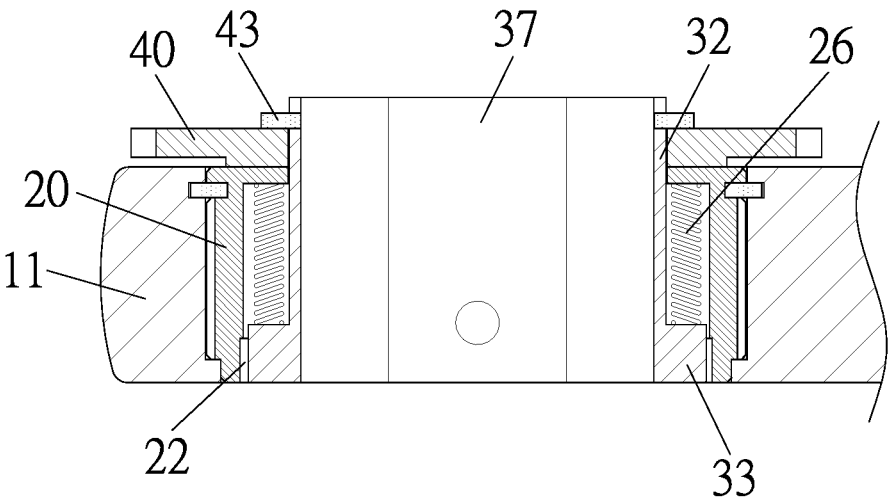
FIG. 3 is a cross sectional view showing the assembly of the engagement structure of the socket wrench taken along the line B-B' of FIG. 1.
Figure 4:
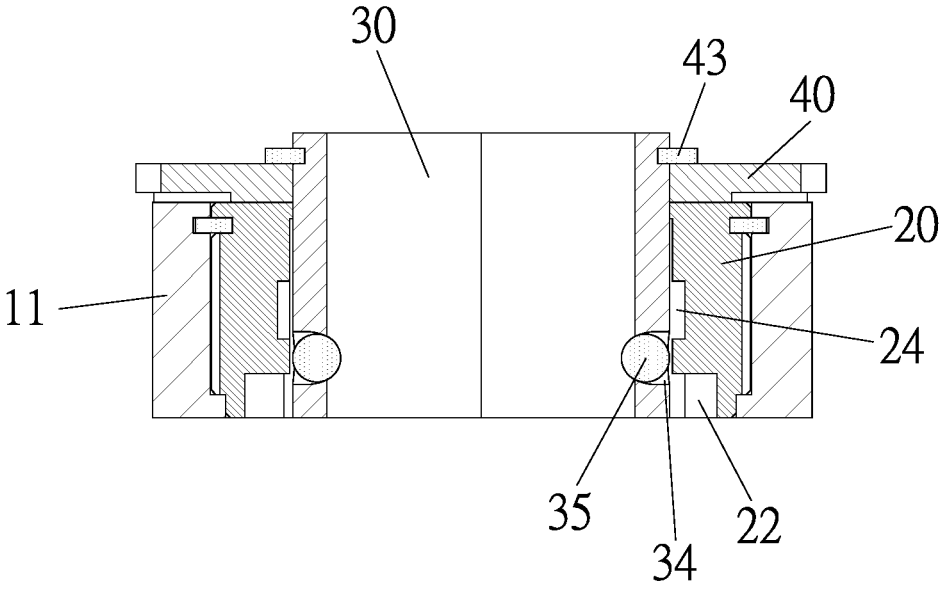
FIG. 4 is a cross sectional view showing the assembly of the engagement structure of the socket wrench taken along the line A-A' of FIG. 1.
Figure 5:
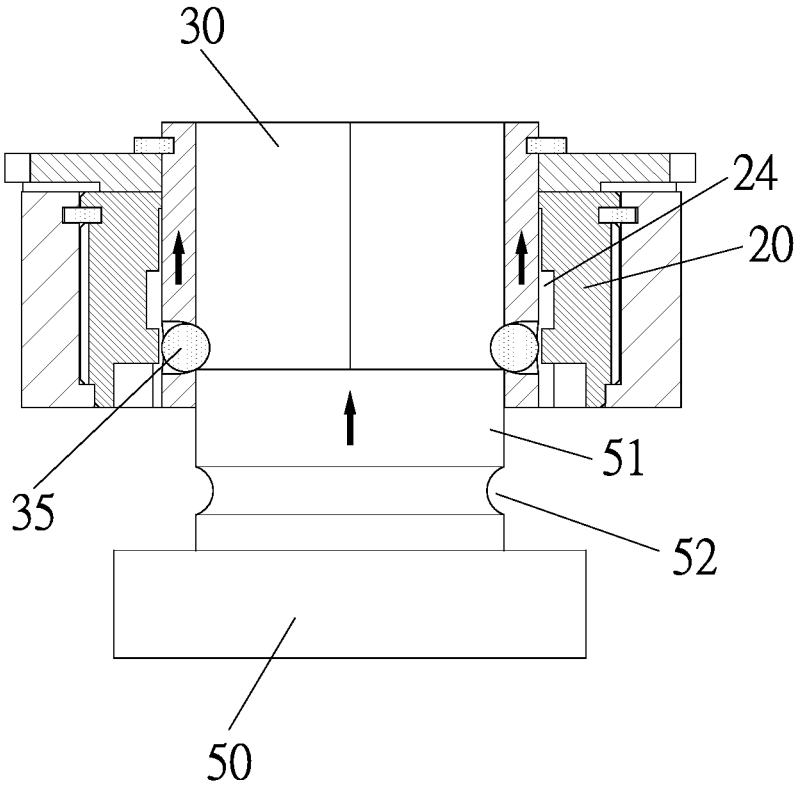
FIG. 5 is a cross sectional view showing the operation of the engagement structure of the socket wrench taken along the line A-A' of FIG. 1.
Figure 6:
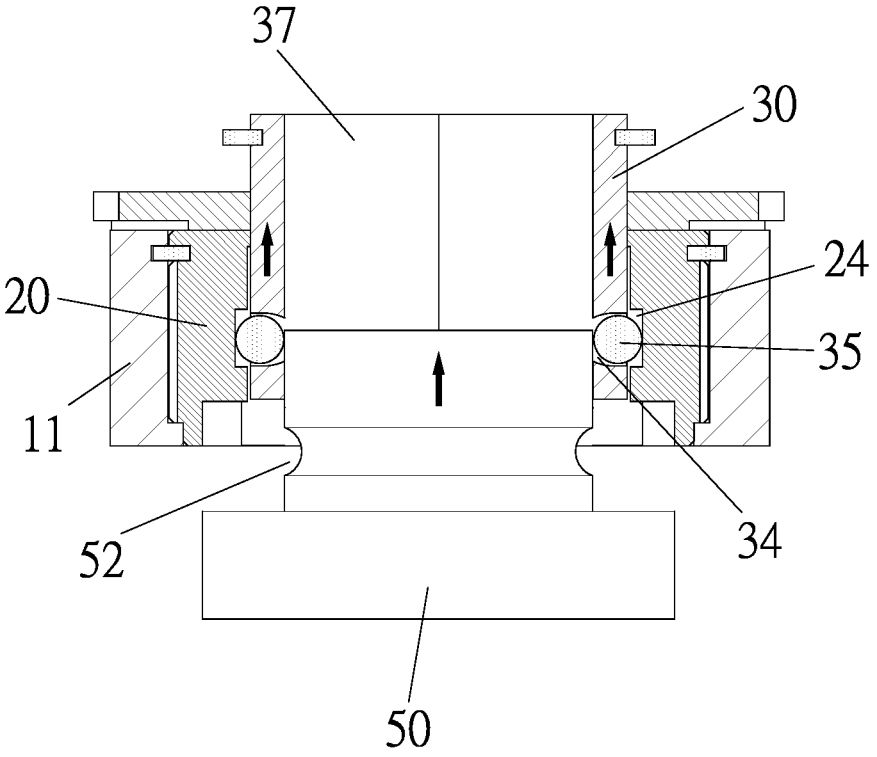
FIG. 6 is another cross sectional view showing the operation of the engagement structure of the socket wrench taken along the line A-A' of FIG. 1.
Figure 7:
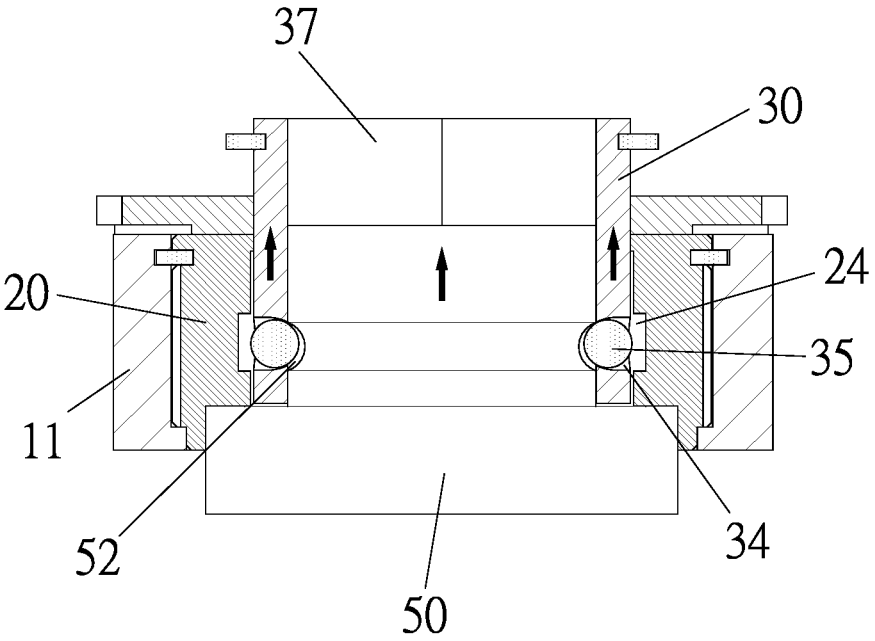
FIG. 7 is also another cross sectional view showing the operation of the engagement structure of the socket wrench taken along the line A-A' of FIG. 1.
Figure 8:
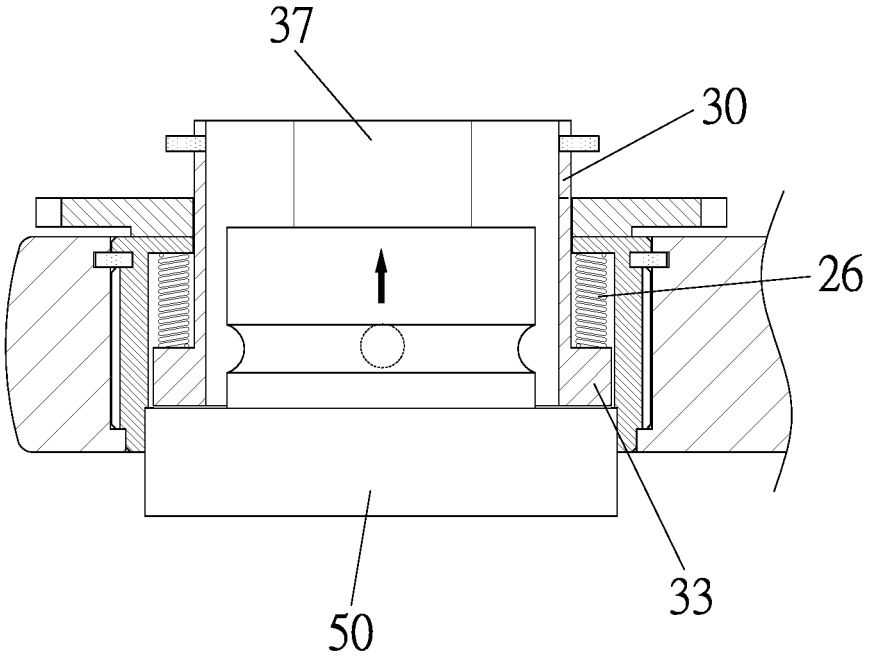
FIG. 8 is a cross sectional view showing the operation of the engagement structure of the socket wrench taken along the line B-B' of FIG. 1.
Figure 9:
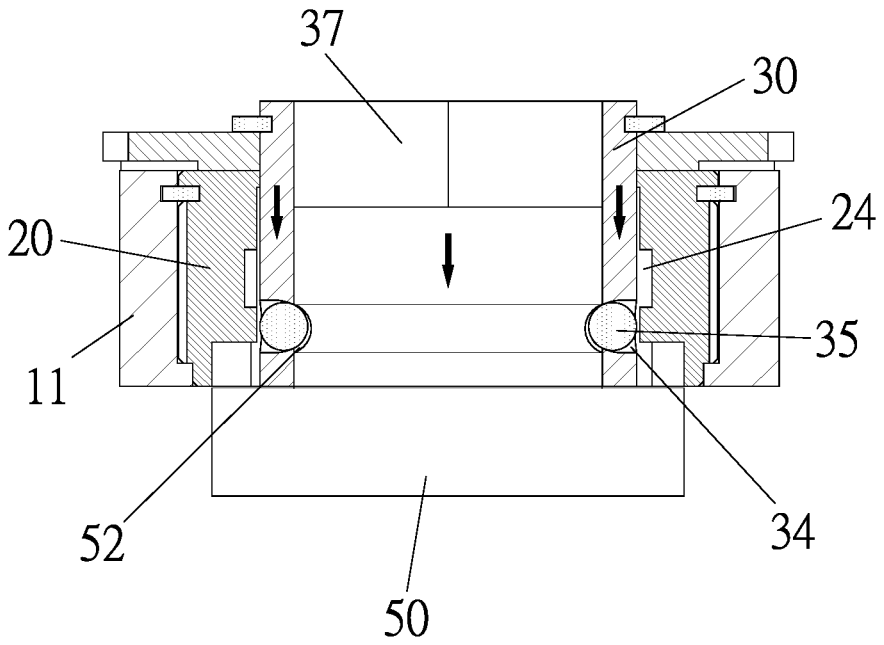
FIG. 9 is still another cross sectional view showing the operation of the engagement structure of the socket wrench taken along the line A-A' of FIG. 1.

With reference to FIGS. 1-4, an engagement structure of a socket wrench according to a preferred embodiment of the present invention comprises: a body 10 including a drive head 11, an accommodation chamber 12 defined in the drive head 11, a ratchet member 20 received in the accommodation chamber 12, a hexagonal groove 21 formed in the ratchet head 11, a circular large-diameter notch 22 formed on a bottom of the hexagonal groove 21, multiple recessed 24 formed around six inner walls of the hexagonal groove 21, multiple cutouts 23 formed on six corners of the six inner walls of the hexagonal groove 21, and a hexagonal small-diameter orifice 25 defined on a top of the hexagonal groove 21.

The hexagonal groove 21 of the ratchet member 20 is configured to accommodate a locating sleeve 30, and the locating sleeve 30 includes an upper extension 32, a hexagonal positioning portion 31 integrally formed with the upper extension 32, a hexagonal receiving hole 37 defined in the locating sleeve 30, multiple columns 33 formed on six corners of an outer wall of the hexagonal positioning portion 31, two opposite central holes 34 defined on two opposite sides of the outer wall of the hexagonal positioning portion 31, two steel balls 35 received in the two opposite central holes 34, and a slot 36 defined around a top of the outer wall of the hexagonal positioning portion 31.

When the locating sleeve 20 is inserted into the ratchet member 20, the hexagonal positioning portion 31 is limited in the hexagonal groove 21, and the multiple columns 33 are fixed in the multiple cutouts 23. The locating sleeve 20 further includes multiple springs 26 fitted on the multiple columns 33 of the multiple cutouts 23, the upper extension 32 of the locating sleeve 30 is connected with of the hexagonal small-diameter orifice 25 of the ratchet member 20 and a hexagonal coupling aperture 41 of a control disc 40, and a C-shaped retainer 43 is engaged in the slot 36 of the locating sleeve 30 so that the C-shaped retainer 43 abuts against the control disc 40, thus connecting the ratchet member 20, the locating sleeve 30, and the control disc 40.

Referring to FIGS. 5-9, when a socket 50 is inserted into the hexagonal receiving hole 37 from a bottom of the locating sleeve 30, an insertion 51 of the socket 50 pushes the two steel balls 35 of the hexagonal receiving hole 37 and the locating sleeve 30 to move upward. When the two steel balls 35 move into the multiple recesses 24 of the ratchet member 20, the socket 50 is released to move into the hexagonal receiving hole 37. When a trench 52 of the insertion 51 of the socket 50 moves to the two steel balls 35, the two steel balls 35 engage into the trench 52 and the two opposite central holes 34 and are defined between the locating sleeve 30 and the socket 50, and the multiple springs 26 push the multiple columns 33 so that the locating sleeve 30 moves back to an original position downward, thus engaging the locating sleeve 30 with the socket 50.

Figure 10:
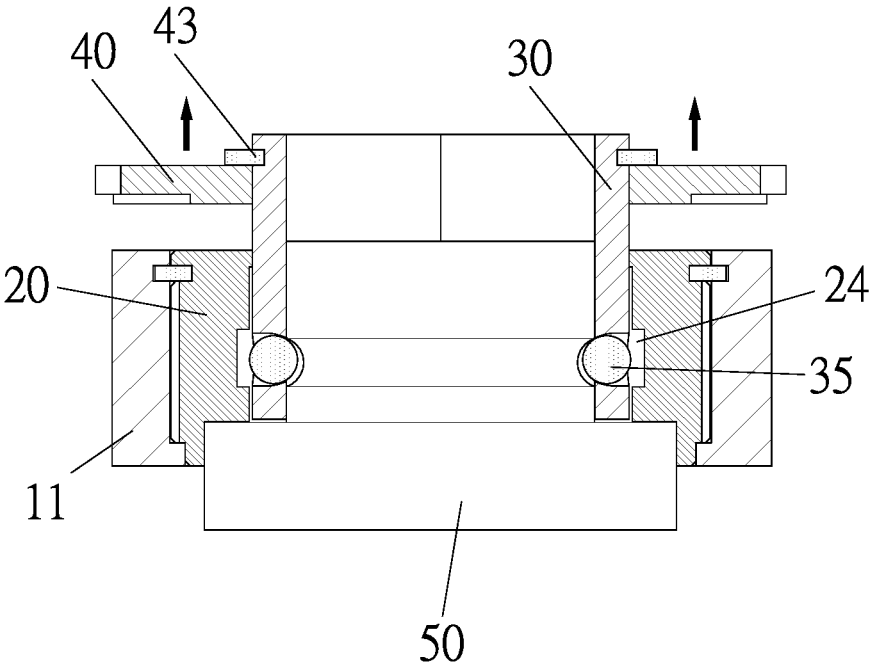
FIG. 10 is another cross sectional view showing the operation of the engagement structure of the socket wrench taken along the line A-A' of FIG. 1.
Figure 11:
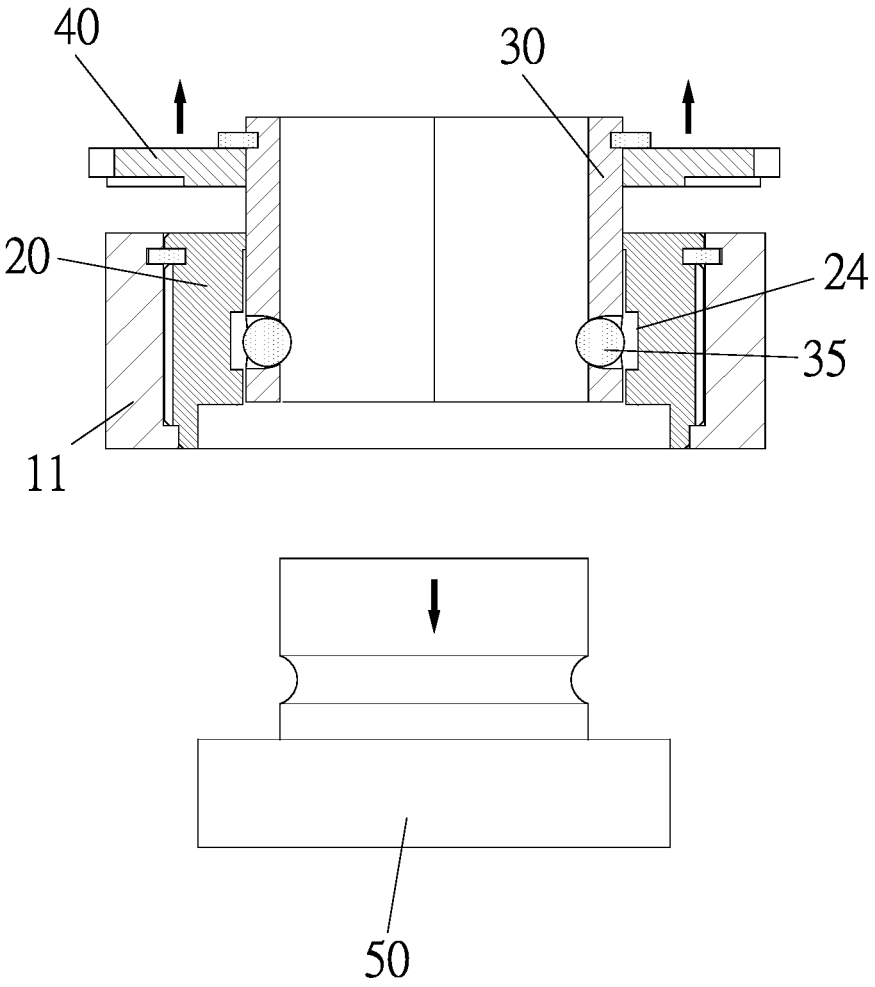
FIG. 11 is also another cross sectional view showing the operation of the engagement structure of the socket wrench taken along the line A-A' of FIG. 1.

Referring to FIGS. 10 and 11, when releasing the socket 50, the control disc 40 is pulled upward to drive the locating sleeve 30 and the socket 50 to move upward, and the two steel balls 35 are pulled to the multiple recessed 24 of the ratchet member 20 and move outward, thus releasing the socket 50.

Figure 12:
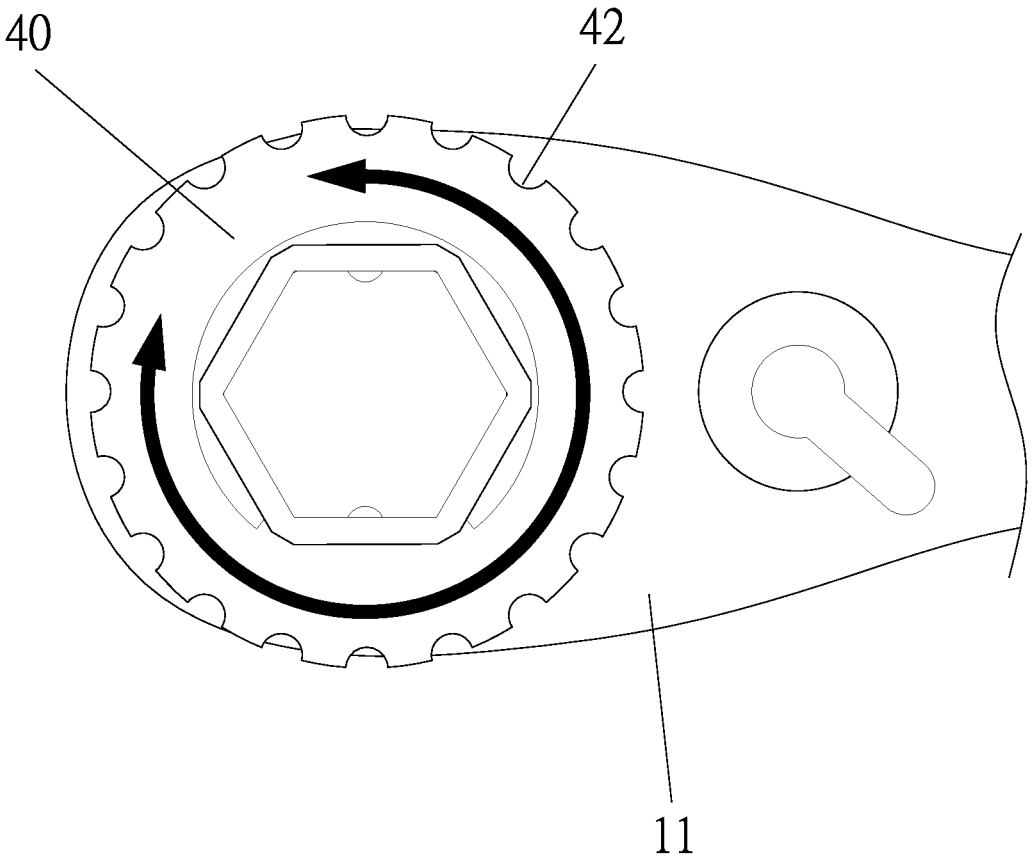
FIG. 12 is a side plan view showing the operation of a part of the engagement structure of the socket wrench according to the preferred embodiment of the present invention.
Figure 13:
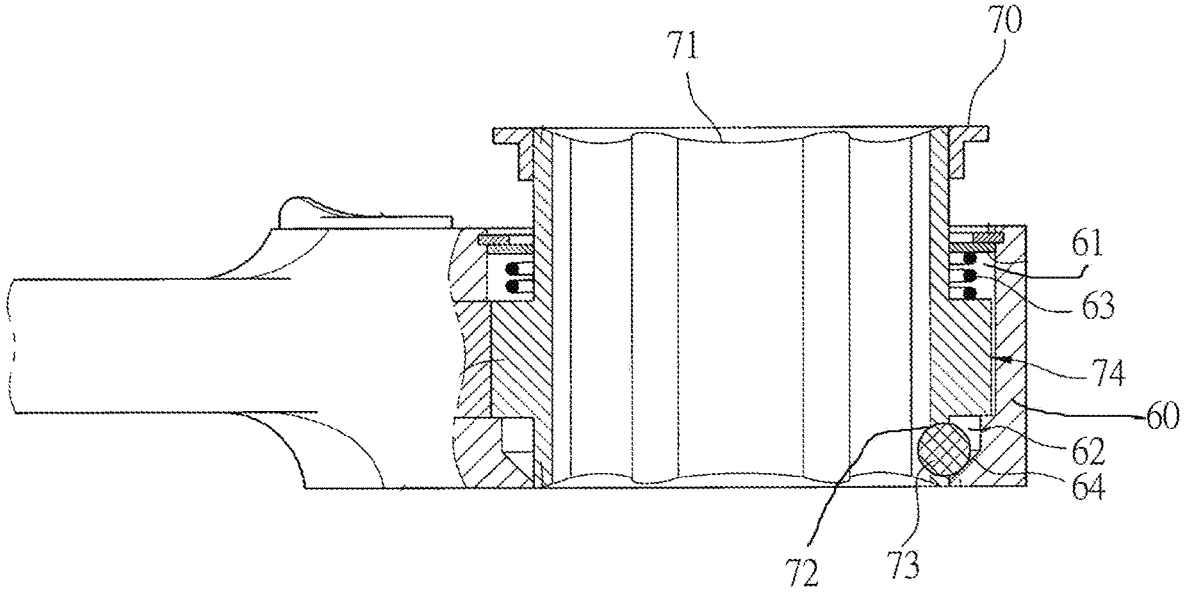
FIG. 13 is a cross sectional view showing the operation of a conventional engagement structure of a socket.
Figure 14:
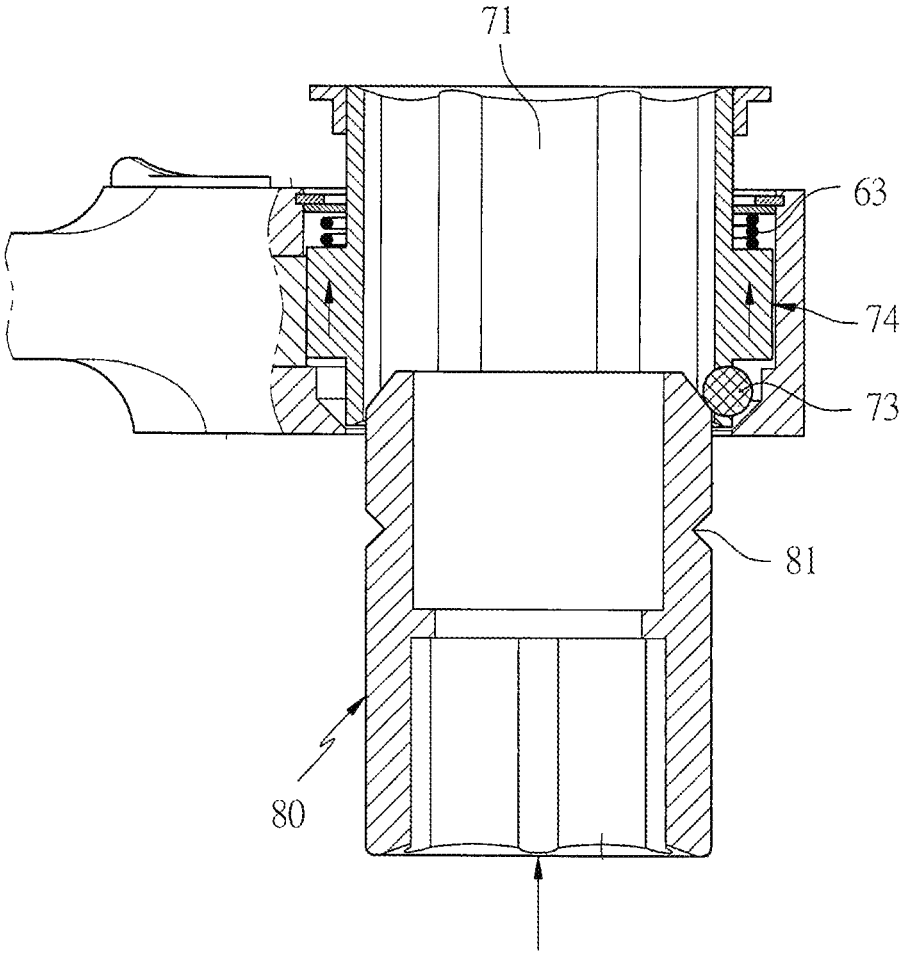
FIG. 14 is another cross sectional view showing the operation of the conventional engagement structure of the socket.
Figure 15:
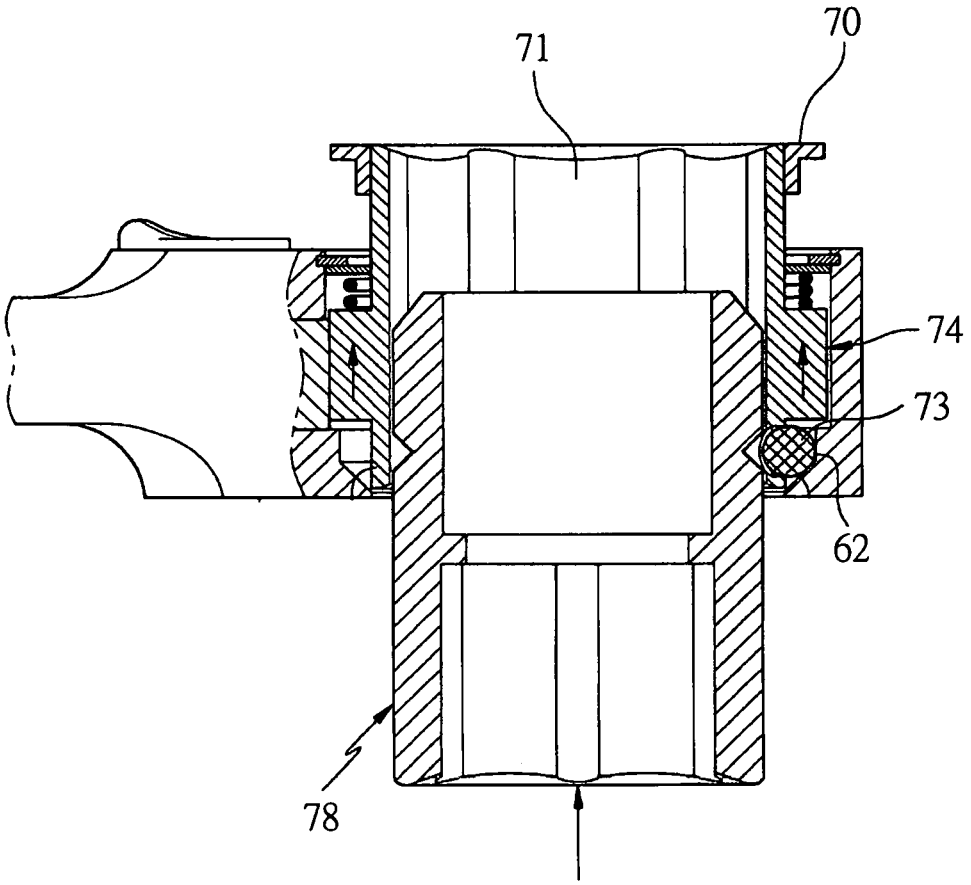
FIG. 15 is also another cross sectional view showing the operation of the conventional engagement structure of the socket.
Figure 16:
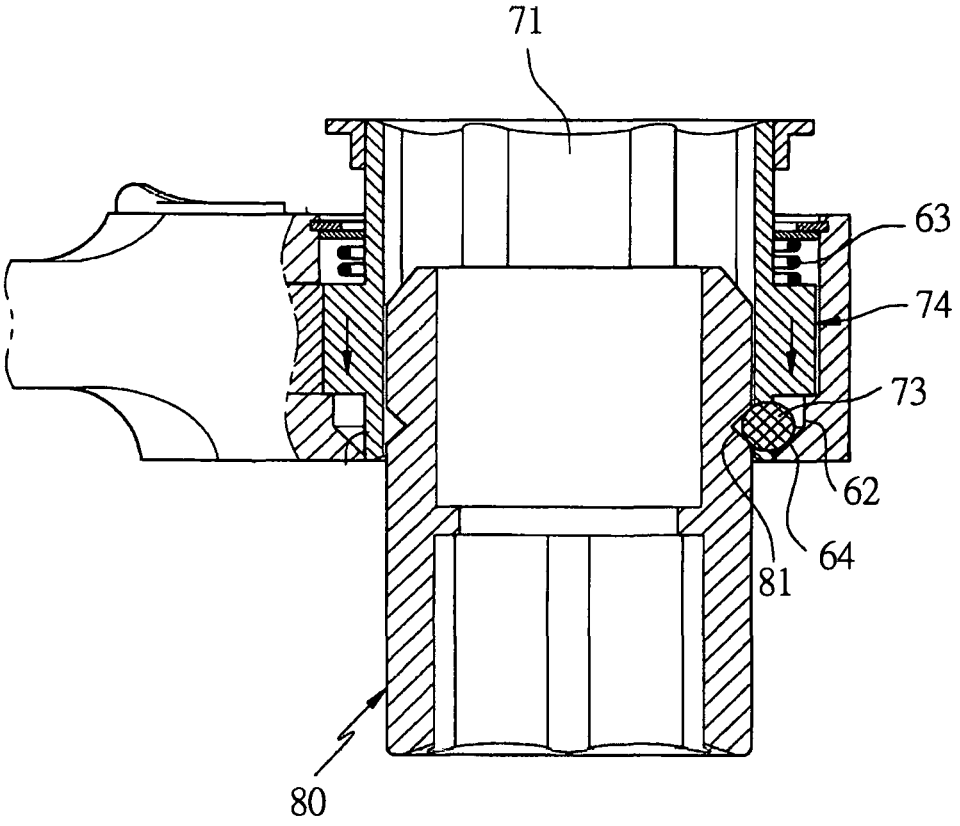
FIG. 16 is still another cross sectional view showing the operation of the conventional engagement structure of the socket.
Figure 17:
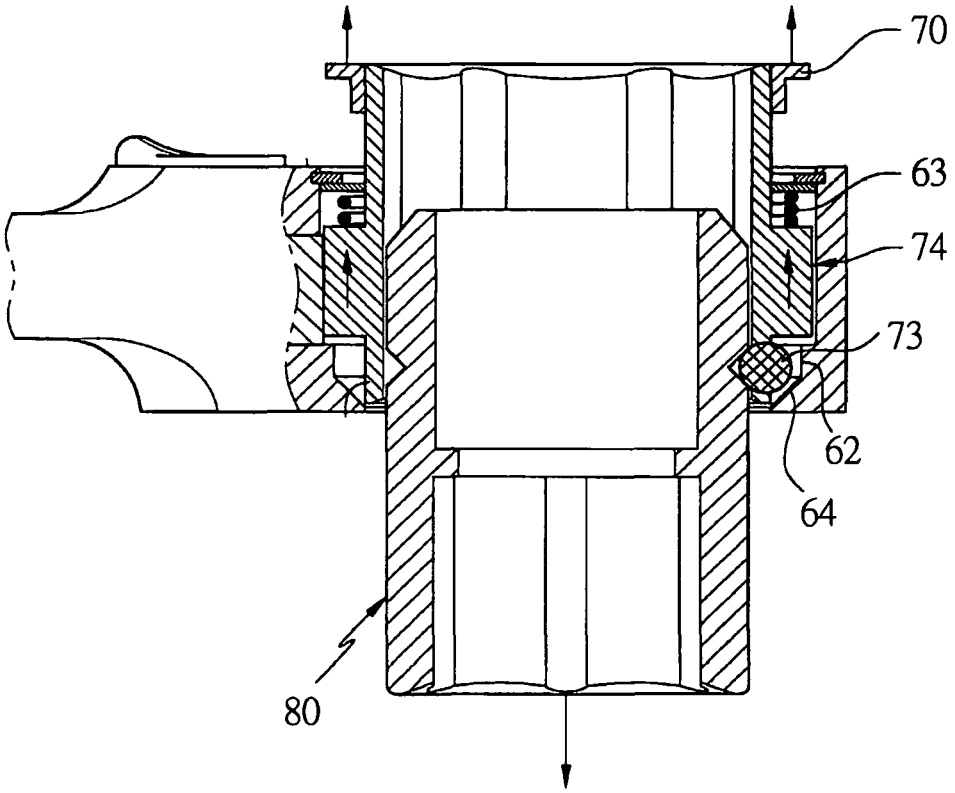
FIG. 17 is another cross sectional view showing the operation of the conventional engagement structure of the socket.
Figure 18:
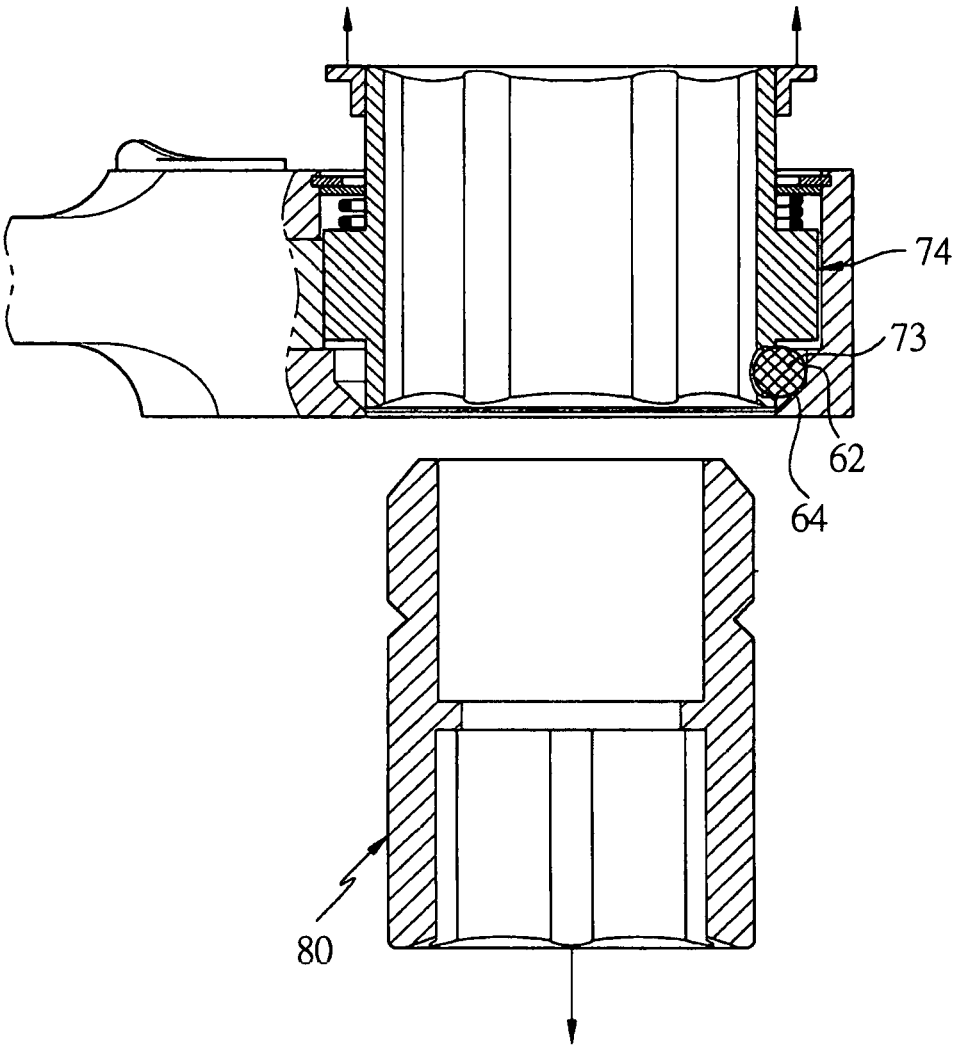
FIG. 18 is also another cross sectional view showing the operation of the conventional engagement structure of the socket.

As shown in FIG. 12, the control disc 40 includes a toothed fringe 42 configured to rotate the control disc 40 clockwise or counterclockwise in a limited space.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. An engagement structure of a socket wrench comprising:

a body including a ratchet drive head, an accommodation chamber defined in the ratchet drive head, a ratchet member received in the accommodation chamber, a hexagonal groove formed in the ratchet drive head, a circular large-diameter notch formed on a bottom of the hexagonal groove, multiple recesses formed around six inner walls of the hexagonal groove, multiple cutouts formed on six corners of the six inner walls of the hexagonal groove, and a hexagonal small-diameter orifice defined on a top of the hexagonal groove;

wherein the hexagonal groove of the ratchet member is configured to accommodate a locating sleeve, and the locating sleeve includes an upper extension, a hexagonal positioning portion integrally formed with the upper extension, a hexagonal receiving hole defined in the locating sleeve, multiple columns formed on six corners of an outer wall of the hexagonal positioning portion, two opposite central holes defined on two opposite sides of the outer wall of the hexagonal positioning portion, two steel balls received in the two opposite central holes, and a slot defined around a top of the outer wall of the hexagonal positioning portion;

wherein when the locating sleeve is inserted into the ratchet member, the hexagonal positioning portion is limited in the hexagonal groove, and the multiple columns are fixed in the multiple cutouts, wherein the locating sleeve further includes multiple springs fitted on the multiple columns of the multiple cutouts; and wherein the upper extension of the locating sleeve is connected with of the hexagonal small-diameter orifice of the ratchet member and a hexagonal coupling aperture of a control disc, and a C-shaped retainer is engaged in the slot of the locating sleeve so that the C-shaped retainer abuts against the control disc, thus connecting the ratchet member, the locating sleeve, and the control disc.

2. The engagement structure as claimed in claim 1, wherein when a socket is inserted into the hexagonal receiving hole from a bottom of the locating sleeve, an insertion of the socket pushes the two steel balls of the hexagonal receiving hole and the locating sleeve to move upward; when the two steel balls move into the multiple recesses of the ratchet member, the socket is released to move into the hexagonal receiving hole; when a trench of the insertion of the socket moves to the two steel balls, the two steel balls engage into the trench and the two opposite central holes and are defined between the locating sleeve and the socket, and the multiple springs push the multiple columns so that the locating sleeve moves back to an original position downward, thus engaging the locating sleeve with the socket.

3. The engagement structure as claimed in claim 1, wherein when releasing a socket, the control disc is pulled upward to drive the locating sleeve and the socket to move upward, and the two steel balls are pulled to the multiple recesses of the ratchet member and move outward, thus releasing the socket.

4. The engagement structure as claimed in claim 1, wherein the control disc includes a toothed fringe configured to rotate the control disc clockwise or counterclockwise.

* * * * *